United States Patent [19]

Reiss et al.

[11] Patent Number: 4,584,727

[45] Date of Patent: Apr. 29, 1986

[54] SOFA BED SPRING IMPROVEMENTS

[75] Inventors: Bernard Reiss, Baltimore; Irl E. Ward, Salisbury, both of Md.

[73] Assignee: Sealy of Maryland and Virginia, Inc., Baltimore, Md.

[21] Appl. No.: 623,089

[22] Filed: Jun. 21, 1984

Related U.S. Application Data

[63] Continuation-in-part of Ser. No. 449,254, Dec. 13, 1982, Pat. No. 4,541,133.

[51] Int. Cl.[4] ..... A47C 17/04; A47C 19/00

[52] U.S. Cl. ..... 5/13; 5/28; 5/189; 5/236 R

[58] Field of Search ..... 5/12 R, 13, 17, 18 R, 5/18 B, 28–36, 189, 191, 236 R, 237, 247, 255; 297/455, 458, 459

[56] References Cited

U.S. PATENT DOCUMENTS

| | | | |
|---|---|---|---|
| 2,016,953 | 10/1935 | Arnold | 297/455 |
| 2,182,485 | 12/1939 | Murdock | 297/455 |
| 3,030,147 | 4/1962 | Kinnebrew | 297/452 |
| 3,098,244 | 7/1963 | Rothbauer, Jr. | 5/247 |
| 3,284,812 | 11/1966 | Koch | 5/13 |
| 3,797,886 | 3/1974 | Griffiths | 297/452 |
| 3,916,460 | 11/1975 | Harty | 5/13 |

FOREIGN PATENT DOCUMENTS

| | | | |
|---|---|---|---|
| 197806 | 6/1978 | Fed. Rep. of Germany | 5/191 |
| 2091092 | 7/1982 | United Kingdom | 5/28 |

*Primary Examiner*—Kenneth J. Dorner
*Assistant Examiner*—Michael F. Trettel
*Attorney, Agent, or Firm*—Roylance, Abrams, Berdo & Goodman

[57] ABSTRACT

A sofa bed has a stationary framework and a foldable bed frame connected to and foldable into the framework, the foldable frame having an outer section connected to and pivotal relative to a body section, the outer section overlying the body section in the folded position of the frame to form a seat. The outer section has a plurality of individual seat support elements extending thereacross transversely to the sofa back. The individual elements are spaced apart in a direction parallel to that axis, and each of the individual elements is downwardly deflectable independently of the other when a person sits on said seat, and is arched so that a concavity is formed in the sofa form for the sofa cushions, and as that the mattress is compressed. A spring edge is mounted on and extends above a front rail of the stationary framework to form the front supporting edge of the seat.

25 Claims, 17 Drawing Figures

FIG.14
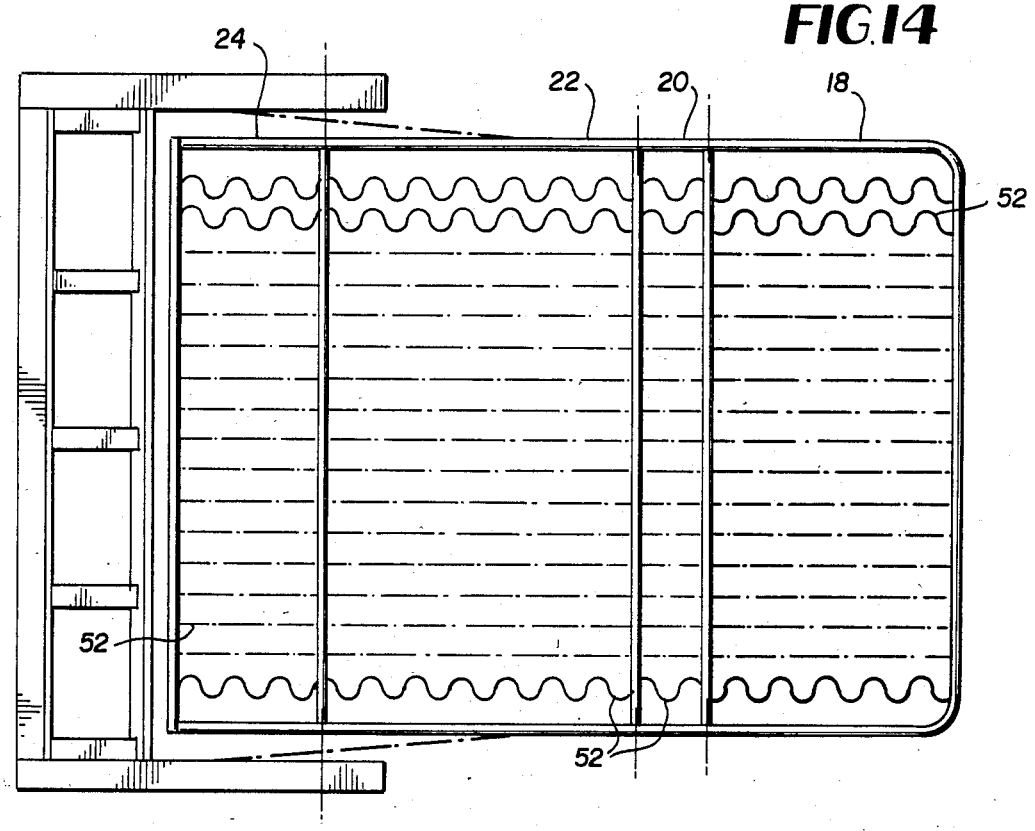
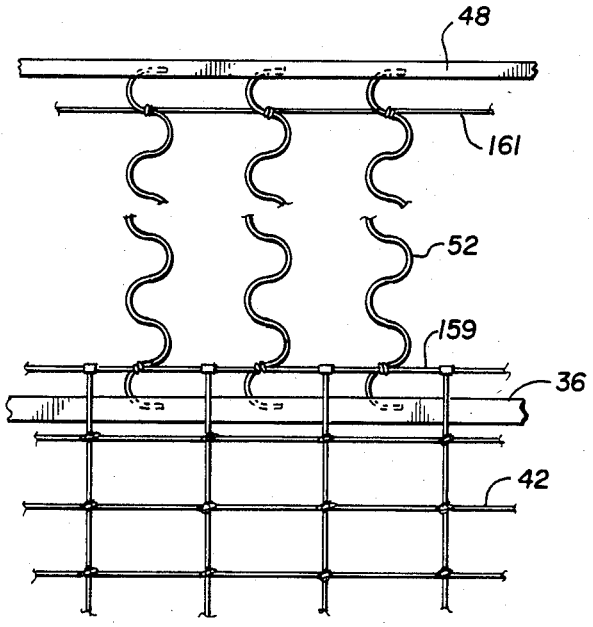
FIG.15

SOFA BED SPRING IMPROVEMENTS

REFERENCE TO PARENT APPLICATION

This application is a continuation-in-part of co-pending application Ser. No. 449,254 filed Dec. 13, 1982, now Pat. No. 4,451,133 entitled "SOFA BED", by the same inventors and assigned to the same assignee, the entire disclosure of which is hereby incorporated herein by reference.

FIELD OF THE INVENTION

This invention relates to sofa beds of the type that have a foldable bed frame which unfolds and extends from a stationary framework to form a bed and is folded into the stationary framework to form a sofa. The foldable bed frame has a plurality of pivotally connected sections, the outer section forming a seat support in the sofa form.

BACKGROUND OF THE INVENTION

Sofa beds of the above type are very useful pieces of furniture, being normally used as a sofa yet being readily convertible into an extra bed when needed. However, this versatility of use is obtained at a sacrifice in the seating comfort of the sofa. There have been many proposals over the years to mitigate this seating comfort problem.

In U.S. Pat. No. 3,854,153 it is proposed that the outer foot section should be formed by a transversely extending strip of heavy canvas connected by coil springs to the front member of the foldable frame. Also, diagonally arranged wires are tensioned under the wire link fabric of the body section to provide better seat cushion foundation when in the sofa position with the canvas forming the seat.

U.S. Pat. Nos. 2,634,427; 2,742,653; 2,749,653; 2,749,559, and 2,812,523 also disclose sofa beds in which a strip of material extends across the foot section to provide a seating surface when in the sofa position.

In U.S. Pat. No. 3,740,775 it is proposed to employ a flexible network in the foot section to improve seating in the sofa position.

However, all the above proposals still suffer from the disadvantage that the sofa seat will exhibit the feeling of "hammocking" whereby the sitting action of one occupant of the sofa is telegraphed to any other occupant of the sofa, and there is a tendency for the occupants to be moved together towards the middle of the sofa.

In U.S. Pat. Nos. 2,985,892 and 3,872,523 is shown the use of individual sinuous wires extending across a frame portion and which support the cushions forming the mattress when these sofas are converted to form single beds. However, these sofas do not have a foldable bed frame which unfolds and extends outwardly to form a full bed. Further, the proposals in these patents only appear to be applicable to a sofa that converts into a single bed.

Another approach to the seating discomfort problem with foldable bed frame type sofa beds has been to incorporate a separate seating surface or seat member on the frame of the bed portion, usually on the underside of the matress fabric, to improve the seating arrangement when the bed is in the closed position. Such arrangements are disclosed in U.S. Pat. Nos. 936,589; 1,058,934; 1,248,702; 1,260,600; 1,296,612; 1,306,756; 1,351,011; 1,374,661; 2,823,389; 2,851,698; and 3,317,929.

Another aspect of seating comfort with a sofa bed is the incorporation of a spring edge at the front of the seat to support and yield to movement of the underside of the thighs of the occupants seated on the sofa. It has been proposed in U.S. Pat. Nos. 2,770,814; 2,818,583 and 2,947,006 to incorporate in sofa beds spring edges along the front rail board of the sofa when in the sofa position. However, these spring edges are mounted on the foldable bed frame and move with the folding and unfolding of the bed frame. This movement of these spring edges every time the bed frame is unfolded or folded exposes them to possible damage and mechanical failure. Moreover, as the spring edge needs to fit snugly between the end arms of the sofa without any unsightly spaces, there is a tendency for the ends of the spring edge to rub against the arms, and possibly other portions of the sofa, during the folding and unfolding with eventual fabric failure due to such rubbing. There is also the risk of the side arm fabric becoming torn before failing due to the rubbing.

SUMMARY OF THE INVENTION

It is an object of the present invention to improve the seating comfort in a sofa bed of the above mentioned type having a foldable bed frame.

A feature by which this is achieved is the elimination of fabric in the outer section and its replacement by a plurality of individual elements extending across the outer section at right angles to the back of the sofa. This has the advantage that each individual element can deflect independently in the seating position thus avoiding "hammocking". It also has the advantage that this seat support is self-supporting and does not require additional support from the mattress which is usually folded and housed in a cavity under the seat. The separate elements can be stiff sinuous wires similar to those known as "No Sag" wires, and made by a company of the same name, plastic straps, and many other such devices which are used in stationary seating furniture.

Another feature of the invention is the mounting of a spring edge on a front rail board of the stationary framework. This has the advantage that the spring edge does not move with the unfolding and folding of the bed frame so reducing the risk of damage to the spring edge and wear and tear on the fabric of the arms of the sofa.

These two features, the individual seat cushion support elements and the stationary spring front edge provide a sofa bed according to the invention which very closely simulates the comfort of a conventional non-convertible sofa. This is a very significant step forward in this art.

Another feature of this invention is the provision of an arch in the sinuous wires which, in the sofa form provides the advantages of creating a concavity to receive the sofa seat cushions which enhances the appearance and seating comfort, and which simultaneously compresses the mattress to thereby permit shortening of the height of the front rail which lowers the profile of the sofa bed overall.

Accordingly, therefore, there is provided by the present invention a sofa bed having a stationary framework and a foldable bed frame connected to and foldable into the framework, the foldable frame having an outer section connected to and pivotal relative to a body section, and the outer section overlying the body section in the folded position of the frame to form a seat. The outer section can have a plurality of individual seat support elements extending thereacross transversely to the axis about which the outer section pivots relative to the body section, the individual elements being spaced apart in a direction parallel to said axis, and each of the individual elements being downwardly deflectable independently of the others when a person sits on the seat. Alternatively, or in addition, a spring edge can be mounted on and extend above a front rail of the stationary framework to form the front supporting edge of the seat.

Preferably, there is a shallow cavity between the outer and body sections in the folded position of the frame, and in this may be stored an air mattress. In prior sofa-beds, the mattress helps support the seat cushions. In the present invention, the seat support separate elements are self supporting. Thus, the frame of the bed structure can be made to fold smaller, which gives great versatility to the furniture designer and which permits storage of a collapsed air mattress or anything else in the folded bed frame.

Yet another feature of the invention is the provision of a firmer support surface in the body section to minimize sagging of this bed section. This firmer support surface may comprise a panel of plywood or the like, or may comprise a plurality of slats extending parallel to the axis about which the outer section pivots relative to the body section. Combinations of these features can also be made.

Other objects, features and advantages of the present invention will become more fully apparent from the following detailed description of the preferred embodiments, the appended claims and the accompanying drawings.

BRIEF DESCRIPTION OF THE DRAWINGS

In the accompanying drawings in which FIGS. 1 to 15 are identical to FIGS. 1 to 15 of our parent application identified above;

FIG. 1 is a plan view of a sofa bed according to the invention illustrated in the extended bed position with upholstery omitted;

FIG. 2 is a plan view of the sofa bed of FIG. 1 illustrated in the folded sofa position;

FIG. 3 is a front view of the folded sofa bed of FIG. 2;

FIG. 4 is a diagrammatic sectional view of the folded sofa bed on the line 4—4 of FIG. 3;

FIG. 5 is a perspective view of part of the sofa bed of FIG. 1 illustrated in a partially folded position;

FIG. 6 is a view, on a larger scale, of part of FIG. 4 with upholstery and a seat cushion present;

FIG. 7 is a plan view, similar to FIG. 1, of another embodiment of the invention in which the body section has a panel, and also shows various types of seating elements according to the invention;

FIG. 8 is a plan view, similar to FIG. 1, of yet a further embodiment of the invention in which the body section has slats;

FIG. 9 is a perspective view of a slat supporting device of FIG. 8;

FIG. 10 is a perspective view, similar to FIG. 9, of an alternative slat supporting member;

FIG. 11 is a plan view of an alternative slat arrangement for the body section of the sofa bed of FIG. 8;

FIG. 12 is a plan view, similar to FIG. 1, of yet another embodiment of the invention;

FIG. 13 is a diagrammatic sectional view, similar to FIG. 4, of the sofa bed of FIG. 12 in the folded position;

FIG. 14 is a plan view, similar to FIG. 1, of a further embodiment of the invention;

FIG. 15 is an enlarged view of the encircled section of FIG. 1 showing a detail;

DETAILED DESCRIPTION OF THE PREFERRED EMBODIMENTS

Figure 1:
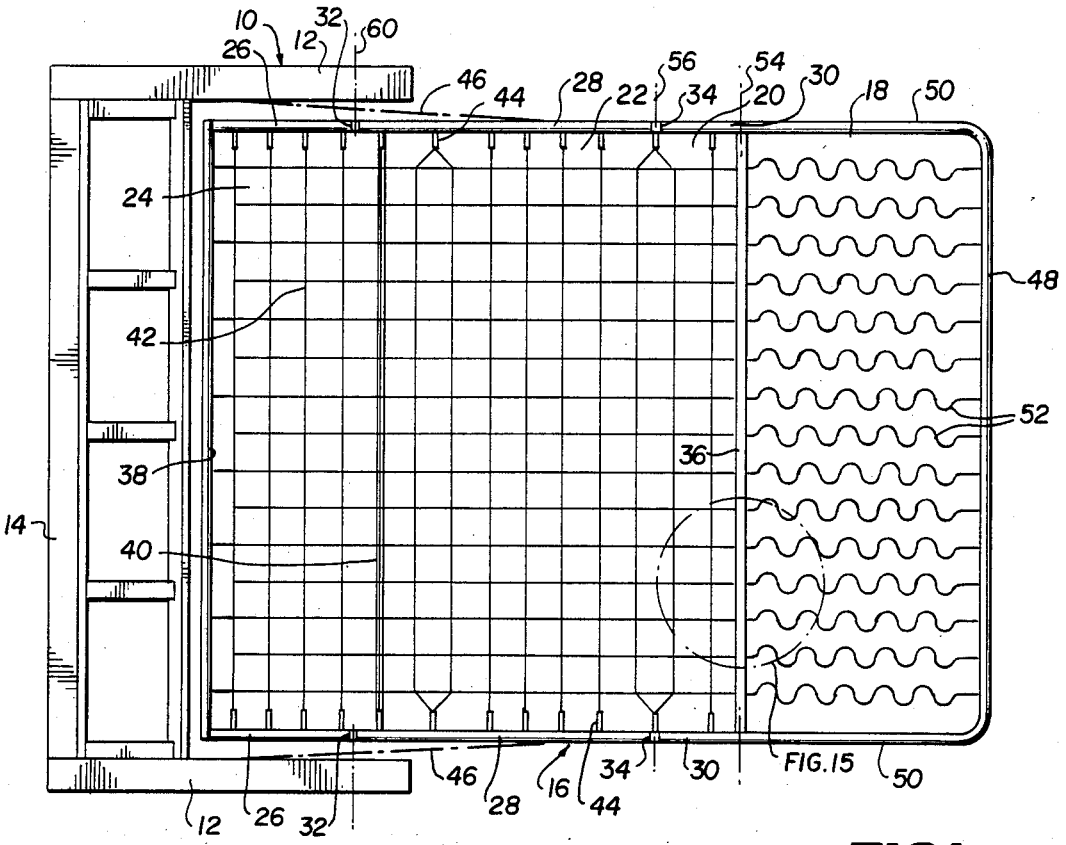

FIG. 1 shows the sofa bed in the extended bed position, with upholstery, some structural members, and details of the spring-loaded lever mechanism for unfolding and folding the bed portion omitted for simplicity and clarity of illustrating the invention. The sofa bed has a stationary framework 10 of wood, or other suitable material, having end arm sections 12 connected by a back section 14. Extending past the front of the framework 10 is a foldable bed structure in the form of a frame 16 having an outer section 18, an intermediate section 20, a body section 22, and a head section 24 all pivotally attached to each other. The head, body, intermediate and outer sections together form the sleeping platform of the foldable bed structure. The head, body and intermediate sections together have three side frame members 26, 28, 30 on each side pivotally connected in pairs at 32 and 34. The two side members 30 of the intermediate section 20 are spaced apart by a cross member 36, and the two side members 26 of the head section 24 are connected by a rear end cross member 38, the two side members 28 of the body section 22 being connected by an intermediate cross member 40. A wire link fabric 42 is stretched between and connected at its ends to the cross members 36 and 38 in conventional manner, and the link fabric 42 is connected along each side to the side frame members 26, 28 and 30 by helical coil springs 44 in conventional manner. The extending sleeping platform is supported above the ground by foldable legs (not shown) in conventional manner, the complete foldable frame 16 of the bed structure being attached to the stationary framework 10 by a conventional spring-loaded, multi-lever folding bed mechanism which is illustrated schematically by the broken lines 46. Such spring-loaded, multi-lever mechanisms are well known and commercially available, and examples are shown and described in the U.S. patents previously referred to.

The outer section 18 constitutes the foot section of the sleeping platform and is formed by a rectangular frame portion having an end cross member 48 with two side members 50 extending rearwardly therefrom and pivotally connected at their ends to the side members 30 of the intermediate section 20. The ends of the side members 50 are also connected to the cross member 36. Stretched, in the lengthwise direction of the bed, between the cross members 36 and 48 are a plurality of sinuous spring wires 52 preferably equi-spaced across the width of the foot section 18, with the ends of the sinuous spring wires 52 being attached to the cross members 36, 48 in any conventional manner, for example by the ends being in the form of hooks inserted through holes in the cross members.

Figure 2:
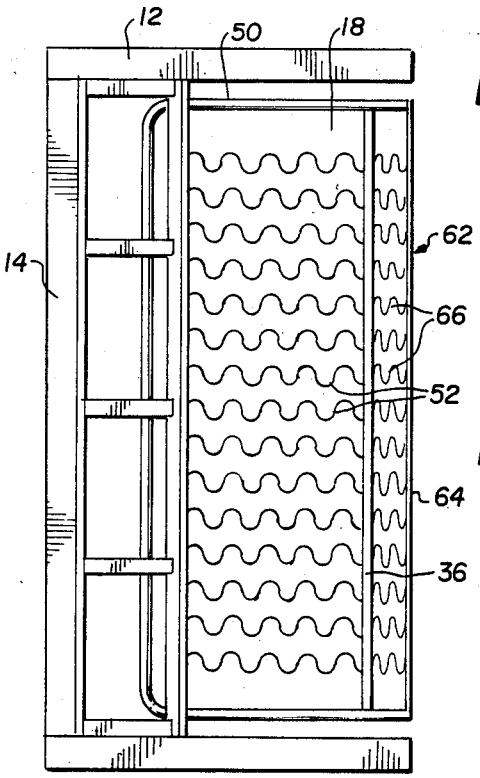

FIG. 2 shows the sofa bed with the foldable bed structure completely folded to function as a sofa. To get to the sofa position shown in FIG. 2 from the bed position shown in FIG. 1, the foot section 18 is pivoted upwardly about the pivotal axis 54 and then the intermediate section 20, together with the foot section 18, are pivoted upwardly about the axis 56 to form a cage 58 (see FIG. 5) with the foot section 18 overlying the body section 22 and spaced therefrom by the length of the intermediate section 20. The cage is then pivoted upwardly about the axis 60 and moved backwards and downwards into the framework 10 of the sofa with the head portion 24 pivoting about the axis 60 and folding upwards behind the back section 14. The cage is then allowed to pivot downwards into the framework 10 of the sofa with the underside of the foot section 18 now forming the deck of the sofa, as shown in FIG. 2. Thus, the seat support of the sofa is formed by the individual sinuous wire elements 52 stretched across the seat portion between the back and front thereof and spaced apart across the width of the seat. This seating surface makes sitting more uniform in feel and comfort than with conventional foldable sofa beds and eliminates the feeling of "hammocking" as will be discussed more fully later.

Figure 6:
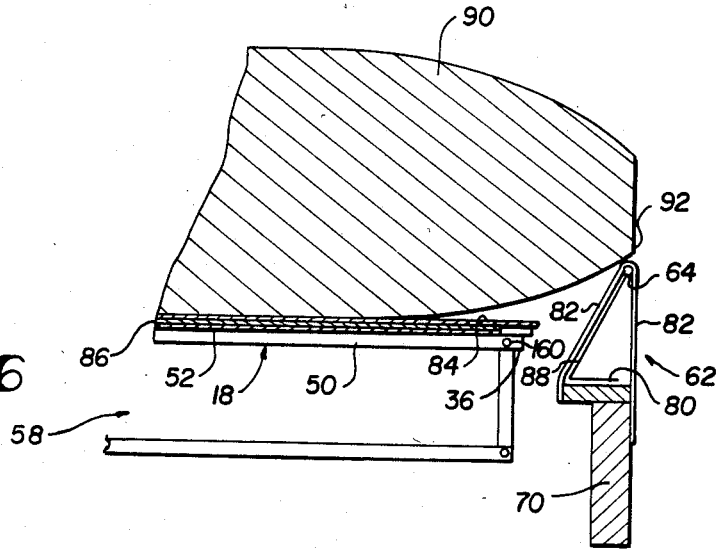

The front of the sofa seat is formed by a front-edge spring assembly 62 comprising a movable comfort bar 64 connected to the tops of a plurality of upwardly and forwardly extending springs 66 mounted on the stationary framework 10 of the sofa bed. As can be seen in FIGS. 2 and 6, the comfort bar 64 and the springs 66 are forward of the leading edge of the seat portion formed by the cross member 36.

Figure 3:
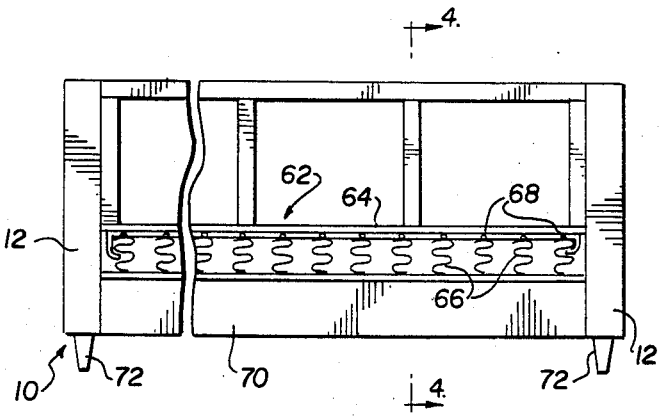

FIG. 3 shows a front view of the sofa bed with the bed structure fully folded. The springs 66 of the spring edge 62 are formed by lengths of sinuous spring wire and connected securely and firmly at their upper ends to the comfort bar 64 by ring staples 68. At their lower ends, the springs are bent over and attached to the upper surface of a front rail 70 of the stationary framework 10, the front rail 70 being connected at its ends to the side sections 12. The springs 66 are preferably equispaced along the width of the seat portion. The comfort bar 64 extends at each end to just short of the side sections 12, so that the bar is spaced a small distance from the side sections 12 and is capable of upward and downward movement relative to the side sections 12 and the front rail 70. The ends 71 of the comfort bar 64 are turned downward and then inward and attached to the end springs 66 intermediate the height thereof. The comfort bar 64 is flexible and resilient, and is preferably made from paper covered 12 gauge spring wire. The stationary framework 10 is supported above the floor on short legs 72.

Figure 4:
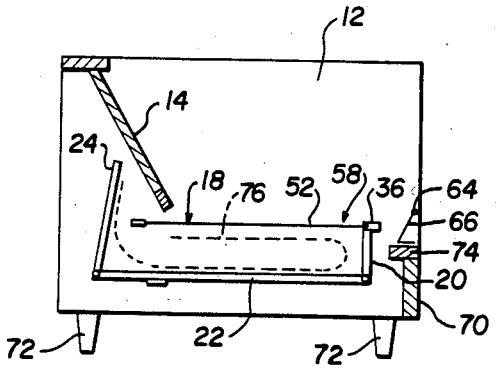
Figure 5:
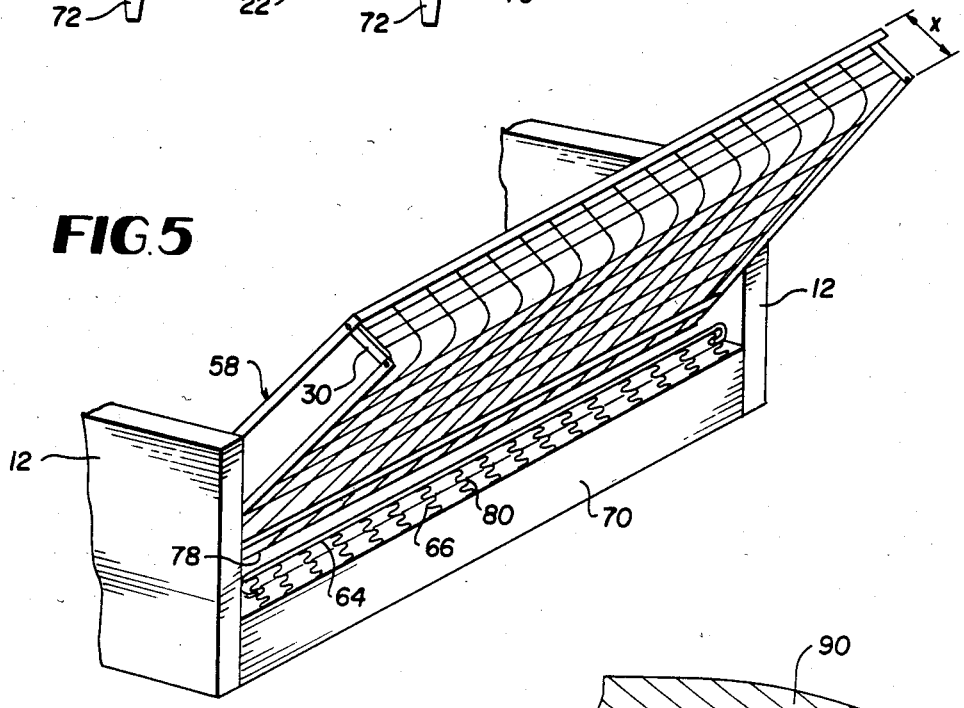

FIG. 4 shows somewhat schematically a section of the sofa bed with the bed structure fully folded. The cage 58 extends rearwardly below the back section 14 and the head section 24 is pivoted upwardly in the space behind the back section 14. The cage 58 is spaced at its forward edge slightly rearward of the front rail 70. The front rail has a wider top part 74 and is reduced in overall height so that it terminates at a height below the seating surface formed by the individual sinuous elements 52 extending from the cross member 36. The comfort bar 64 is positioned forwardly substantially in the plane of the front surface of the front rail 70, and is located at a height above the height of the cross member 36 and individual elements 52. As can be seen in FIGS. 4 and 5, each spring 66 of the spring edge extends downwardly and rearwardly from the comfort bar 64 to the rear edge of the top 74 of the front rail, and then extends forwardly across the upper surface of the front rail. The top surface of the front rail, and the lower ends of the springs 66, are intermediate the height of the cage 58. The individual sinuous springs 52 form a self supporting seating surface. They do not need support from a mattress folded inside the cage 58, as do the seating surfaces of conventional sofa beds. This enables the depth of the cage shown as dimension "x" in FIG. 5, to be reduced by shortening the length of the side members 30 of the intermediate section 20. Thus, the depth of the cage can be chosen depending upon what it is required to store inside the cage, and also upon the desired height of the end arm sections 12 and the length of the legs 72. This gives the furniture designer more latitude in design than with conventional sofa beds in which a rather bulky cage has to be concealed. The cage can be left empty, in which case it can be very shallow, or can contain a standard folded mattress, in which case it would need to be deeper. A mattress 76 is shown in broken lines stored in the cage 58, and preferably does not touch the sinuous spring wires 52 of the seat but is spaced a distance therebelow. Preferably, the mattress 76 is an air bed, the deflated air bed requiring only a shallow cavity in the cage and not interfering with the action of the individual sinuous elements 52.

FIG. 5 shows the bed structure partly unfolded from the position of FIGS. 2, 3 and 4. It will be noticed that the rearward lower edge 78 of the cage 58 is still below the height of the comfort bar 64, but as the cage is pivoted downwards this lower edge 78 is raised by the conventional lever mechanism so that the lower surface of the cage extends outwardly above the level of the comfort bar 64 which is at approximately the height of the usual front rail board of conventional sofa beds. The lower horizontally disposed end portions 80 of the upwardly inclined edge springs 66 can be seen extending across the wide upper surface 69 of the front rail 70. The upper member 69 forms a stable enlarged platform for the lower ends 80 of the edge springs 66. The thickness X of the cage is preferably less than that in a conventional sofa bed and may be decreased further by shortening the length of the pair of side members 30.

FIG. 6 illustrates a portion of the sofa bed after it has been upholstered. Suitable upholstery 82 is stretched over the comfort bar 64 and attached to the rear and front surfaces of the front rail 70 to form an upholstered spring edge 62 extending above the front rail 70. The sinuous seat springs 52 are covered with a layer of upholstery fabric 84, preferably backed with a layer of padding 86. Similarly, the upholstery fabric 82 of the spring edge 62 is preferably backed with padding 88. Each seat cushion 90 is placed on the upholstered surface of the foot section 18 of the cage. The extension of the spring edge 62 above the height of the deck 18 creates a well in which the cushion 90 is located. Due to the bulge in the upper and lower sides of the cushion, the lower leading edge seam 92 of the cushion is raised above the height of the deck 18 and rests against the top of the spring edge 62.

The spring edge gives considerable comfort to the lower support of the thighs of a person sitting on the sofa, and allows a substantial amount of downward deflection of the front of the cushion 90 as necessary to accommodate the position or movement of the occupant. It will be appreciated, that as the spring edge 62 is attached to the stationary framework 10 of the sofa bed and does not move when the bed mechanism is folded and unfolded, the spring edge assembly 62 is not subjected to wear during these folding and unfolding operations, and does not create any wear on the end or arm sections 12.

The foot section cross member 36 pivots with the foot or outer section 18 and is located at or adjacent the pivotal joint between the foot section 18 and the intermediate section 20 so that the cross member 36 pivots with the side members 50 of the foot section 18. This ensures that the individual sinuous elements 52 are not subjected to bending when the foot section 18 is folded rearwardly to form the cage. Thus, the sinuous springs 52 always remain extended in a straight line and under the same tension when forming the foot section as in FIG. 1 or the seat supporting surface as in FIG. 2. In other words, the cross member 36 is positioned so that there is no change in length of the sinuous springs 52 when the sleeper mechanism is opened to form the bed or closed to form the sofa seat.

The sinuous springs 52 may be connected to the cross members 36 and 48 in any convenient manner, and, if desired, means may be provided for preventing the individual sinuous springs from moving transversely at their ends and slipping out of the cross members when under substantial tension such as when supporting a heavy seated person. For example, the end portions of the sinuous springs connected to the front cross member can be held in spaced apart relationshp by means of transverse wire 161 (see FIG. 15) immediately adjacent the front cross member.

The advantages of the individual longitudinally extending members include that they do not need support from a folded mattress in the cage 58 in the seating position, and eliminate the uncomfortable feeling of "hammocking".

In conventional sofa beds, the mattress platform is made of woven fabric, steel link fabric, wire mesh, wire cable fabric, etc. Such platforms are usually anchored as an entire prefabricated surface around its whole perimeter to the frame members; thus, the seat tends to be acted upon in its entirety to a greater or lesser degree. It will depress more at points most distant from the anchoring points and will depress less at points close to the anchoring points. This creates unlevel seating and aesthetically unpleasant sagging of seat cushioning to the center of the seat, especially if the folded mattress in the cage does not fully fill the cage cavity. This gives rise to "hammocking".

The individual spring elements 52 of the present invention act and are downwardly deflectable independently of each other and furnish equal support along the length of the seating surface of the sofa. This permits each person to sit independently on his or her section of the seat without telegraphing any sitting action to another person on the seat.

With the seating surface of the present invention there is no need to fill the mattress cavity in the cage, the individual elements 52 furnishing all the support needed for comfortable seating. Thus, the cavity can be left empty; preferably the cavity is used to store a deflated air mattress with an appreciable clearance space between the folded mattress and the seating support surface as illustrated in FIG. 4. However, if desired, the mattress can be a conventional foam or innerspring mattress.

Figure 7:
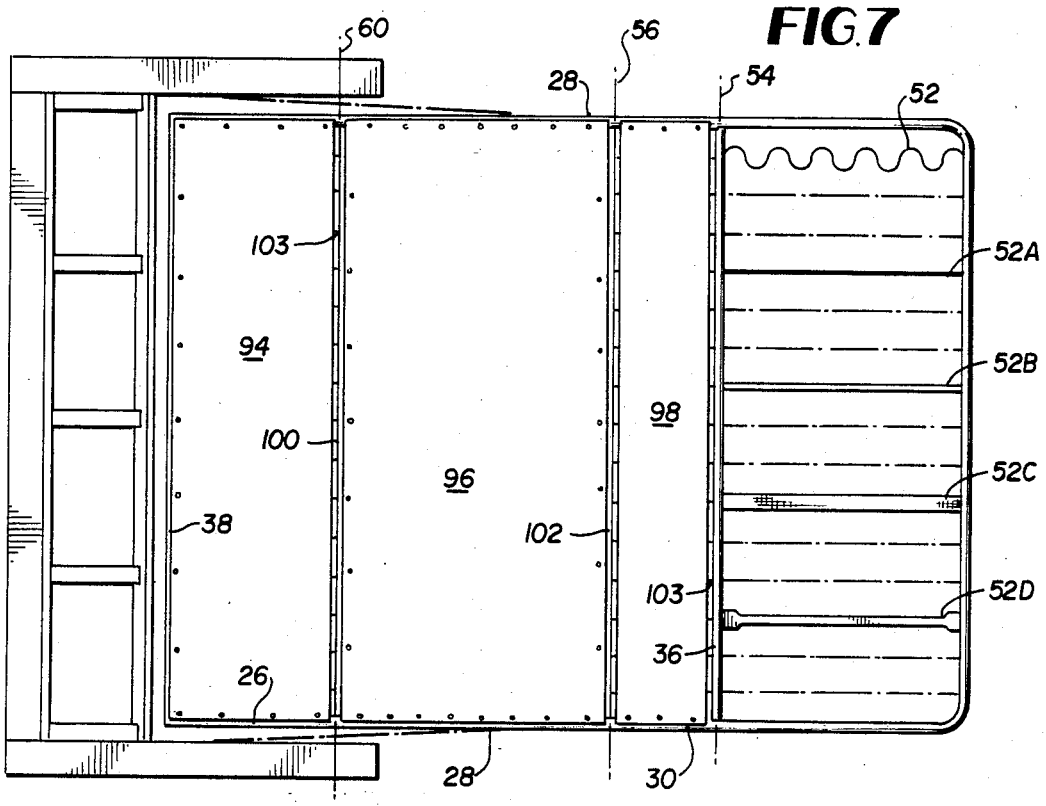

Although the individual seating elements 52 are preferably formed by sinuous spring wires, they could be formed by individual longitudinally extending spring wires, flat springs, elastic webs, elastic straps, cloth straps, plastic straps, leather straps, flexible epoxy resin elements, or other elastic elements spaced apart individually and independently across the width of the seating surface or deck of the sofa to make sitting more uniform in feel and comfort. FIG. 7 shows several such elements, 52A, 52B, etc., it of course being understood that only one such type of element would be used in any one piece of furniture. By way of example, 52A is a longitudinally extending spring wire, 52B is a flat spring wire, 52C is an elastic web and 52D is a cloth strap with enlarged, reinforced ends. Thus the term "support elements" as used herein shall be understood to include any such individual devices.

FIG. 7 shows a modification of the sleeping platform of the embodiment just described with respect to FIGS. 1 through 6, to improve the sleeping comfort. Only the differences in the embodiment of FIG. 7 will be described, all other details being the same as the embodiment shown in FIGS. 1 through 6. The link fabric of the head, body and intermediate sections has been replaced by three separate panels 94,96 and 98 of plywood or the like. Cross members 100, 102 are located at the pivotal axes 60, 56, respectively, and attached to the pair of side members 28. The panels 94, 96 and 98 are attached for support at their side perimeters to the pairs of side members 26, 28 and 30, respectively, by any suitable means, such as rivets, bolts, etc. The rear perimeter of the panel 94 is similarly attached to the rear cross member 38, and the transverse rear and forward edges of the body section panel 96 are similarly attached to the cross members 100 and 102. The transverse rear and forward edges of the intermediate section panel 98 are attached to the cross members 102 and 36 by flexible straps 103, and the forward transverse edge of the head section panel 94 is similarly attached to the cross member 100 by flexible straps 103 to enable the bed structure to be folded. These solid panels 94,96,98 form bearing platforms that support the mattress and prevent any tendency for the sleeping platform to exhibit "hammocking" and sagging under the body weight of sleeping occupants. In this respect the body section 96 is, of course, the most important.

Figure 8:
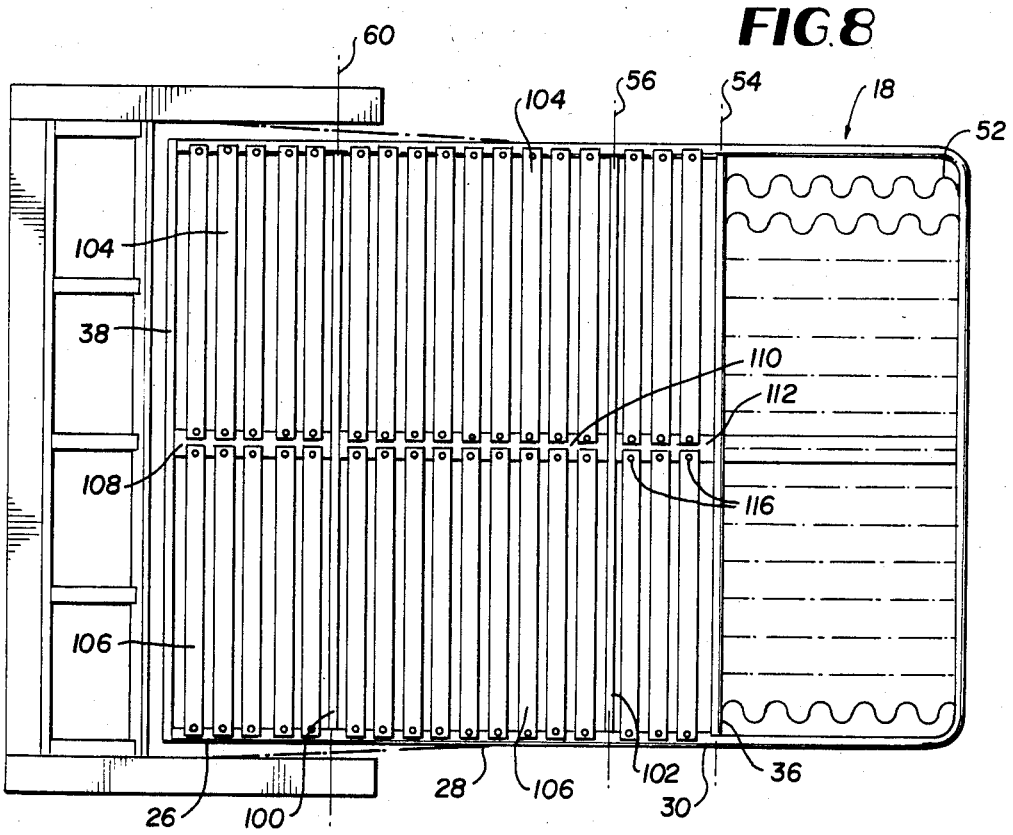

FIG. 8 shows another modification of the sleeping platform to further improve sleeping comfort. The embodiment of FIG. 7 has been modified by replacing the panels of the head, body and intermediate sections with parallel pairs of slats 104, 106. Each of these sections is provided with a central support member 108, 110, 112 appropriately connected to the centers of pairs of adjacent cross members 38, 100; 100, 102; 102, 36; respectively. The ends of the slats 106 are articulated and connected by shock absorbing devices 116 to the respective side members 26, 28 or 30 and the respective central support members 108, 110 or 112 for support thereby. Each pair of slats 104, 106 extends transversely across the sleeping platform, and the pairs of slats 104, 106 are equally spaced throughout the head, body and intermediate sections of the sleeping platform. With this arrangement each slat operates independently, and in particular each slat of each pair of slats 104, 106 operates independently so that the movement of an occupant of one half of the double bed is not telegraphed to the other occupant. The foot or end section 18 is provided, as in FIG. 1, with sinuous spring wires 52 which also provide independent support for each occupant.

Figure 9:
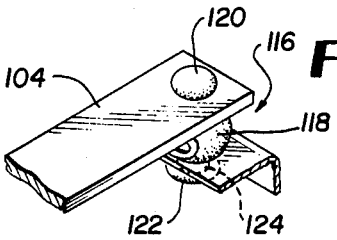

FIG. 9 shows the manner in which the ends of the slats 104, 106 are articulately and resiliently connected to the side and central support members. Each resilient shock absorbing device 116 has a ring shaped central part 118 having a button 120 at the top that snaps through a hole in an end of the slat 104 or 106 and a slightly larger button 122 at the bottom that snaps through a hole, which has a downwardly extending peripheral flange 124, in the side or central support member. The device 116 allows the end of the slat to pivot about a vertical axis and allows the slat to twist about the longitudinal axis of the slat. Further, the end of the slat can move upward and downward a limited amount and tilt due to the resiliency of the ring shaped central part 118 of the device 116 which is made of resilient material.

Figure 10:
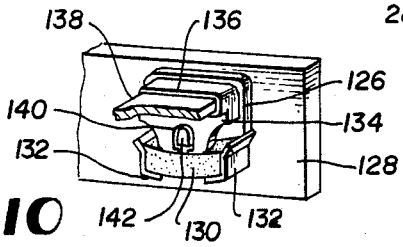

FIG. 10 shows an alternative shock absorber device for mounting the ends of the slats. This device has a rigid housing 126 of plastics material which is mounted on the side of a side or central member 128 of the foldable bed frame by adhesive and/or screws. A resilient pad 130 of rubber or the like is supported by and retained in sockets 132 at the base of the housing 126. A slot retaining member 134 has a socket 136 in which an end 138 of a slat is engaged. The slat retaining member 134 has a downwardly directed channel 140 which engages over and is mounted on a correspondingly shaped peg 142 extending from the housing 126. The slat retaining member 134 engages the resilient pad 130 and, due to the channel 138 engaging around the peg 142, flexes the pad 130 downwardly. The slat retaining member 134 can pivot to a limited extent on the peg 142 against the action of the resilient pad 130, and can also similarly rock away from and back towards the frame member 128. The member 134 is also capable of limited up and down movement against the action of the pad 130. Thus, the end 138 of the slat is articulately and resiliently mounted on the frame member 128. It will be noticed that the frame member 128 is of flat bar form, while the frame member in FIG. 9 is shown as angle iron. The frame members can conveniently be of angle iron, bars, or a combination of angle irons and bars.

Figure 11:
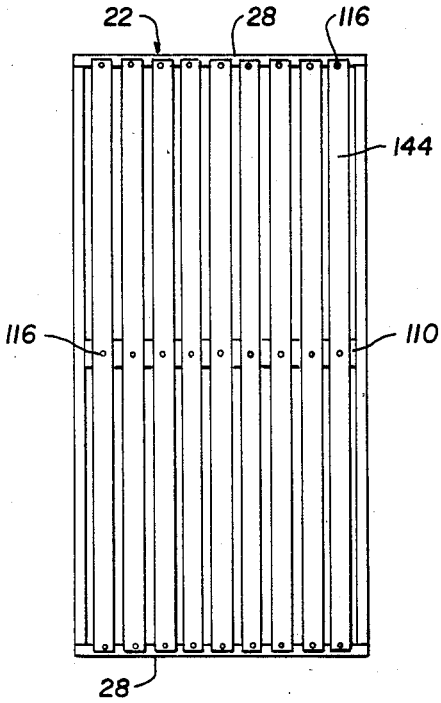

FIG. 11 shows a modification of the embodiment of FIG. 8 in which each pair of slats 104, 106 is replaced by a single long slat 144. FIG. 11 shows only the body section 22 in which the parallel, transverse slats 144 are mounted on the side frame members 28 by shock absorbing devices 116 (as shown in FIG. 9). The long slats 144 are also resiliently and articulately mounted at their centers on the central support member 110 by shock absorbing devices 116. Due to the length of the single slats 114, their central mounting on the central support member 110 eliminates sagging and allows the slats 114 to be made of lighter construction than without the central support member 110. The head and intermediate sections of the bed structure are preferably similarly constructed, but can be of any other suitable construction such as, for example, of link fabric as shown in FIG. 1.

The use of articulated slats, as described in relation to FIGS. 10 and 11, provides a sleeping platform that has some give and movement to conform to body contour and body movement of the occupants. Such systems are commercially available.

Figure 12:
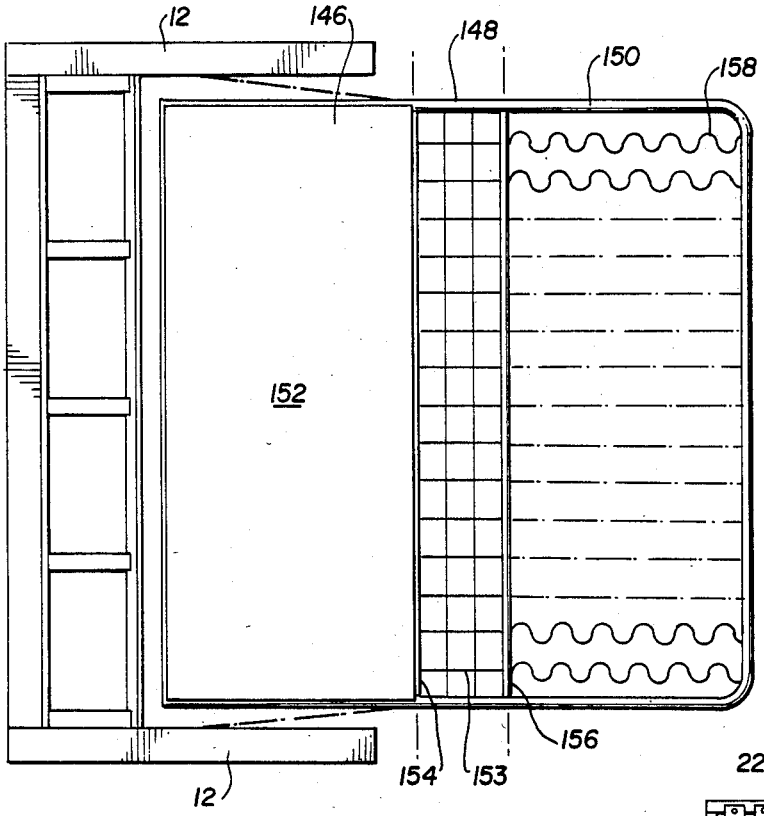
Figure 13:
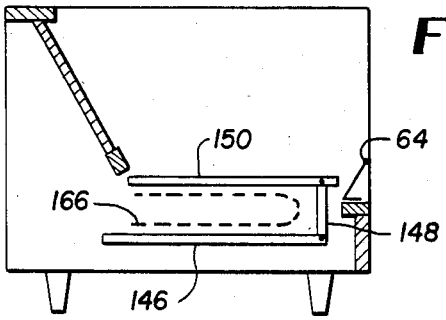

FIGS. 12 and 13 show another embodiment of the invention applied to a sofa bed having a so called clamshell mechanism. This mechanism has only three pivoted sections, namely a body section 146, an intermediate section 148, and an end section 150. In the extended position of the bed structure shown in FIG. 12, a double bed is provided in which the occupants sleep transversely, i.e. parallel to the back of the sofa, one occupant being supported by the body section 146 with his or her head adjacent one arm section 12 and feet adjacent the other arm section 12, and the other occupant being supported by the outer section 150. The body section 146 has a solid panel 152 similar to the panel 96 in the body section of FIG. 7. The intermediate section 148 has link fabric 153 extending between and connected to intermediate cross members 154 and 156, and the end section has independent elements 158 similar to any of the types described above. The bed structure folds up similarly to the embodiment of FIGS. 1 through 6, and FIG. 13 shows schematically a cross section of the folded bed structure in sofa form with the underside (in the bed form) of the end section 150 now forming the deck of the sofa. FIG. 13 is similar to FIG. 4, including a spring edge having a comfort bar 64, except there is no head section extending up behind the back section of the sofa, and the mattress 166 (indicated by a broken line) has only one fold and does not have a portion extending up behind the sofa back. The individual elements 158 provide an improved seating support which does not exhibit hammocking and does not require any support from the folded mattress 166. In the extended bed form, the panel 152 forms a firm, non-sagging mattress support, and the sinuous springs—which are transverse to the length of the sleeping occupant being supported—provide good support for the mattress.

It will be appreciated that in the embodiments of FIGS. 7 through 13, the presence of the panels or slats reduces any tendency for lateral sway in the extended bed structure as such panels and slats also act as extra cross members to further lock the bed frame side members to each other.

FIG. 14 shows a further modification of the embodiment of FIGS. 1 through 6 in which individual elements 52, such as sinuous spring wires, are not only employed in the foot section 18 but are employed in each of the other sections 20, 22 and 24, these individual elements 52 being strung between pairs of frame cross members.

Combinations of the invention's features are possible. For example, the slats of FIG. 8 could be turned 90° and used in FIG. 12 in place of panel 152.

Further, in the embodiment of FIG. 7 the rigid panels 94 and 98 may be connected to the rigid panel 96 of the body section by link wire fabric, straps, springs, or other suitable flexible linking device instead of being connected to the cross members 100 and 102.

Also, in any of the embodiments above any of the sections of the bed structure can be provided with solid panels, individual slats, or pairs of slats to improve the bearing support of the mattress and reduce hammocking and sagging under body weight, although as previously mentioned the body section is the most important section in which to prevent sagging.

It will be appreciated that the present invention will permit sofa bed designs with relatively short front rails and/or higher legs without exposing the folding mechanism and mattress as conventional sofa beds would. It also permits greater latitude in design because screening of the folding mechanism is no longer a problem. Thus, sofa beds can be provided that closely conform to standard stationary sofas in appearance and seating comfort.

The invention also provides another means by which softer seating and firmer mattress support are both accomplished through the same device.

Referring to FIGS. 6 and 15, by attaching the link deck fabric to a point forward of the pivot point 160 about which the seat section articulates for opening and closing, the link fabric is made to tighten when opened for sleeping and loosen when closed for seating.

This is accomplished by providing an anchoring member 159 forward of pivot point 160 closer to the foot end shown in FIG. 6. This anchoring member may be member 36 or member 159 located even more forward as illustrated in FIG. 15. To create more tension in the open position this anchoring member 159, preferably of paper covered 12 Ga. wire, is shown attached to the fabric 42 by means of clips of other suitable means.

This arrangement serves the purpose of tensioning the entire link fabric when the mechanism is opened because the link fabric moves a greater distance and is stretched correspondingly when the mechanism opens. The amount of the increased distance is proportional to the thickness of member 36 and by moving member 159 to the left in FIG. 6 the distance the fabric 42 will be stretched when opened is correspondingly increased. The net result is creation of a firmer more supportive surface for the mattress. Furthermore, when the mechanism is closed the link fabric is under less tension, thus providing more yielding, softer, deeper, more comfortable seating.

The element 161 adjacent to member 48 is similar to member 159, but it serves only to prevent side slippage of elements 52. Element 159 serves that function as well as the tensioning function discussed above.

The foot section independent seat support members of the invention, which permit the space within the folded linkage to be empty while providing good seating support, has a cooperative effect with the different mattress decking embodiments of the invention. The use of those forms of the mattress decking according to the invention which have a substantial height dimension (when the mattress deck is unfolded flat), such as the slat form of FIGS. 8 and 11 in particular, which heretofore could not have been used in prior art convertible furniture with a mattress folded in place, can be used in convertible furniture using the invention independent seating feature since the folded mattress is not needed for seat support.

Figure 16:
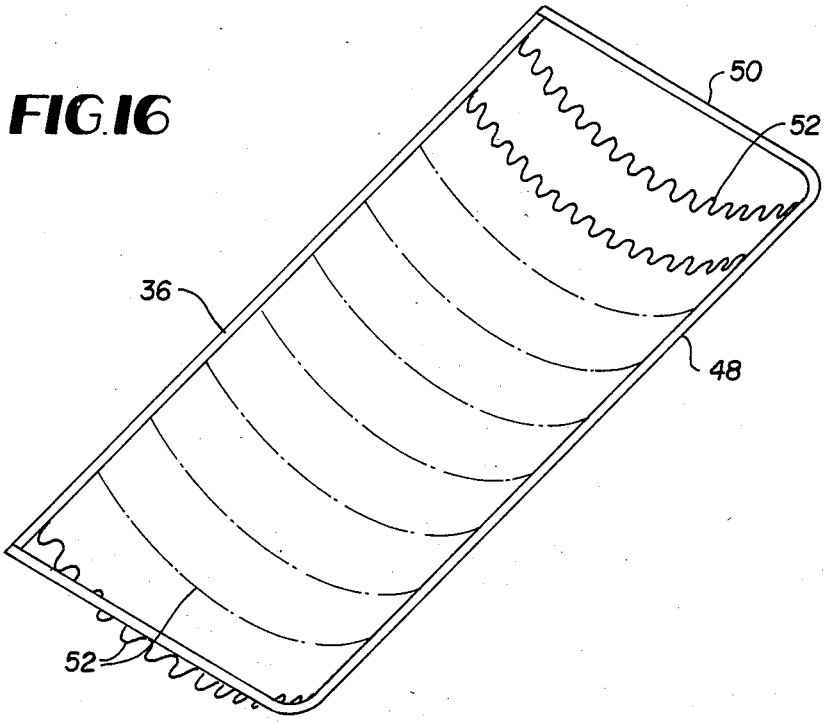
FIG. 16 is a partial perspective view of a foot section only of the sofa bed of FIG. 1 showing the arched sinuous wire embodiment.
Figure 17:
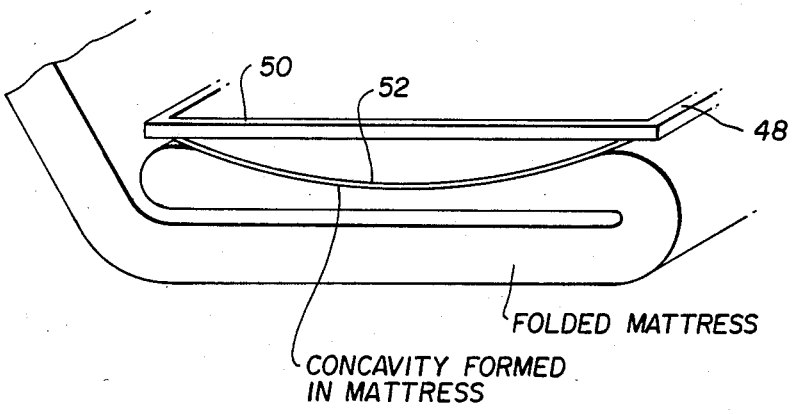
FIG. 17 is a partial perspective view partially schematic, showing the foot section of FIG. 16 in the sofa form.

Referring to FIGS. 16 and 17, another embodiment is shown wherein the sinuous wires in the foot section are showing having an arch. It is known in stationary furniture to form such an arch in these sinuous wire supports, but this feature is totally unknown in convertible furniture. The feature can be used in the present invention because the foot section is completely, in effect, functionally separate from the rest of the folding bed structure.

More specifically, the sinuous wires 52 in this embodiment of FIGS. 16 and 17 are arranged in the foot section framework so that their archs are concave downwardly in the folded position shown in FIG. 17. The arched sinuous wires will, of course, be convex upwardly in the unfolded mattress condition, but this is not a factor in sleeping comfort since that is the foot end of the bed. Further, the amount of the arch is such that the effect on sleeping comfort is negligible.

This arching of the sinuous wires in the FIGS. 16 and 17 form provides important advantages for this form of the present invention. In the folded or sofa configuration, the arched sinuous wires exert a downward force on the mattress, the mattress otherwise normally bulging in its confined space after the bed mechanism has been folded down and around the mattress. This downward force acting on an otherwise convex mattress bulge creates a concavity in which a conventionally configured seat cushion used in the sofa arrangement naturally nests. The nesting is an important advantage so that the seat cushion will meet the front rail of the sofa without leaving an unsightly gap. Such a gap which is unslightly and highly undesirable from an aesthetic point of view does sometimes occur when the convex mattress bulge causes the seat cushion to rise up from the deck on which it is normally to be positioned in the sofa configuration. Further, this prior art arrangement also creates a tendency for the seat cushion to rock from front to rear, thus further enhancing the unpleasant appearance when not in use.

This problem has been heretofore attempted to be solved by the prior art by raising the height of the front rail to meet the cushion. This creates different problems, namely, causing the front of the sofa bed to have a more box-like appearance, and brings it further away from simulating the appearance of a conventional stationary sofa.

Thus, this arched sinuous wire embodiment produces the advantages and solves the problems in the prior art of giving the furniture designer more freedom to simulate stationary furniture in sofa beds embodying the invention, to make the cage even smaller, and to provide a better arrangement of the sofa seat cushions on the folded bed structure. In summary, the embodiment of FIGS. 16 and 17 provides still further advantages for the present invention, both by itself, in combination with sinuous wire generally, and further in combination with the improved spring front edge on top of the front rail of the sofa.

The above-described embodiments, of course, are not to be considered as limiting the breadth of the present invention. Modifications, and other alternative constructions, will be apparent which are within the spirit of the invention and scope of the appended claims.

What is claimed is:

1. A sofa bed, comprising:

a stationary framework;

a foldable bed frame connected to and foldable into said framework, said foldable frame having an outer section pivotally attached to an intermediate section which is pivotally attached to a body section, the outer section overlying the body section in the folded position of the frame to form a seat deck;

said outer section having a plurality of individual seat support elements extending thereacross transversely to the axis of pivotal attachment of said outer section to said intermediate section, said individual elements being spaced apart in a direction parallel to said axis, and each of said individual elements being downwardly deflectable independently of the others when a person sits on said seat deck;

each of said individual elements comprising a sinuous spring wire, and said spring wires being arched and mounted so as to create a concavity adapted to receive a sofa seat cushion in the sofa form of said sofa bed;

said outer section comprising a frame defining a plane, the arch of each of said individual sinuous spring wires with respect to said plane being such as to cooperate with said sofa seat cushion to tend to prevent said seat cushion from sliding off of said outer section;

said arch of each of said individual sinuous spring wires with respect to said plane being such as to match the curvature of a mattress folded into said sofa bed and compressed by said wires to the curvature of said seat cushion thereabove;

said arch of each of said individual sinuous spring wires with respect to said plane being such as to raise the feet of a user reclining on the bed form of said sofa bed above the plane of said outer section frame;

and said arch of each of said individual sinuous spring wires with respect to said plane being such, due to the compression of said mattress in the sofa form of said sofa bed, as to permit use of heavier gauge spring coils in said mattress, if said mattress is an inner spring mattress, than could be used if said elements in said outer section were contained in said plane.

2. The sofa bed of claim 1, wherein said outer section comprises a frame portion having an outer end cross member connected to an inner cross member, said cross members being spaced apart and connected together by a pair of side members, said individual elements being attached at their ends to said outer and inner cross members respectively, and said inner cross member being connected to said intermediate section such that said individual elements extend the same length between said cross members in both the folded and unfolded positions of the frame.

3. The sofa bed of claim 1, wherein said outer section has a frame portion having outer and inner spaced apart cross members, and the only attachment of said individual elements to other parts of said outer section is the connection of each of said individual elements at its ends to said cross members.

4. The sofa bed of claim 1, wherein said outer, intermediate and body sections form a cage in the folded position of said frame, and further comprising an air mattress, the air mattress being stored in the deflated condition in said cage with a clearance between the deflated air mattress and said individual elements.

5. The sofa bed of claim 1, wherein said body section comprises a solid panel connected to said foldable bed frame and forming a supporting platform for a mattress in the unfolded position of said frame.

6. The sofa bed of claim 5, wherein said body section has a pair of side members transverse to said axis, and said panel is a sheet of plywood attached to said side members.

7. The sofa bed of claim 5, wherein said foldable frame has a head section pivotally attached to said body section on the opposite side to said intermediate section, and said head section and said intermediate section each comprise a separate solid panel connected to said foldable bed frame, the panels of said head, body and intermediate sections together with said individual elements of said outer section supporting the mattress in the unfolded position of said frame.

8. The sofa bed of claim 1, wherein said body section comprises a plurality of slats disposed parallel to said axis.

9. The sofa bed of claim 8, wherein said slats are articulately and resiliently supported at their ends on said foldable frame.

10. The sofa bed of claim 9, wherein said body section has a pair of side frame members and a central support member therebetween transverse to said axis, and each slat is articulately and resiliently supported on said central support member and at least one of said side members.

11. The sofa bed of claim 10, wherein each slat extends only from one of said side members to said central support member.

12. The sofa bed of claim 9, wherein said intermediate section comprises a plurality of slats articulately and resiliently supported at their ends by said foldable frame.

13. The sofa bed of claim 1, wherein said foldable frame has a head section pivotally attached to said body section on the opposite side to said intermediate section.

14. The sofa bed of claim 13, wherein said head section has a plurality of individual sinuous spring wires extending thereacross transversely to said axis.

15. The sofa bed of claim 14, wherein said intermediate and body sections each have a plurality of individual sinuous spring wires extending thereacross transversely to said axis.

16. The sofa bed of claim 1, wherein a plurality of said sections each have a plurality of individual support elements extending thereacross transversely to said axis, said individual elements in each section being spaced apart in a direction parallel to said axis and being downwardly deflectable independently of the other individual elements in that section.

17. A sofa bed, comprising:

a stationary framework having a back section and a fixed front rail;

a foldable bed frame connected to said framework, said foldable frame being extendable from said framework to form a bed and being foldable into said framework to form a sofa having a seat deck;

said foldable frame having an outer section connected to and pivotal relative to a body section, the outer section overlying the body section in the folded position of the frame to form said seat deck;

a spring edge mounted on and extending above said front rail to form the front supporting edge of the sofa seat;

said outer section having a plurality of individual seat support elements extending transversely to said back section, said individual elements being spaced apart across said outer section, and each of said individual elements being downwardly deflectable independently of the others when a person sits on said seat deck;

each of said individual elements comprising a sinuous spring wire, and said spring wires being arched and mounted so as to create a concavity adapted to receive a sofa seat cushion in the sofa form of said sofa bed;

said outer section comprising a frame defining a plane, the arch of each of said individual sinuous spring wires with respect to said plane being such as to cooperate with said sofa seat cushion to tend to prevent said seat cushion from sliding off of said outer section;

said arch of each of said individual sinuous spring wires with respect to said plane being such as to match the curvature of a mattress folded into said sofa bed and compressed by said wires to the curvature of said seat cushion thereabove;

said arch of each of said individual sinuous spring wires with respect to said plane being such as to raise the feet of a user reclining on the bed form of said sofa bed above the plane of said outer section frame;

the arch of each of said individual sinuous spring wires with respect to said plane being such, together with the configurations of said cushion and said spring edge that, no gap tends to form between the front end of said cushion and said spring edge due to the containment of said cushion within said concavity;

and said arch of each of said individual sinuous spring wires with respect to said plane being such, due to the compression of said mattress in the sofa form of sofa bed, as to permit use of heavier gauge spring coils in said mattress, if said mattress is an inner spring mattress, than could be used if said elements in said outer section were contained in said plane.

18. The sofa bed of claim 17, wherein said outer section has a frame portion having outer and inner spaced apart cross members, said individual elements are sinuous spring wires, and the only attachment of each sinuous spring wire to the rest of the outer section is by the ends of that sinuous spring wire being connected to said cross members.

19. The sofa bed of claim 17, wherein said body section comprises a solid panel connected to said foldable bed frame and forming a supporting platform for a mattress when the sofa bed is in the bed form.

20. The sofa bed of claim 17, wherein said body section comprises a plurality of slats disposed parallel to said back section, the slats being articulately supported at their ends on said foldable frame.

21. The sofa bed of claim 20, wherein said body section has a pair of side frame members and a central support member therebetween all transverse to said slats, and each slat is articulately and resiliently supported on said central support member and at least one of said side members.

22. The sofa bed of claim 17, wherein:

said foldable frame has an intermediate section disposed between and pivotally connected to said body and outer sections, and a head section pivotally connected to said body section on the opposite side to said intermediate section;

said head, body, intermediate and outer sections each having a pair of side frame members; and at least one of said head, body and intermediate sections having a plywood panel connected to the pair of side frame members of that at least one section and forming a supporting platform for a mattress when the sofa bed is in the bed form.

23. The sofa bed of claim 17, further comprising an air mattress which is stored in the deflated condition in a cavity between said body and outer sections when the sofa bed is in the sofa form.

24. The sofa bed of claim 17, wherein:

said spring edge comprises a plurality of upwardly and forwardly inclined springs attached at their lower ends to said front rail, and a flexible bar extending parallel to and above said front rail, the upper ends of said springs being attached to said bar; and in said folded position of the frame, said bar is spaced forwardly of said outer section and the latter is disposed at a height intermediate said bar and the top of said front rail.

25. A sofa bed, comprising:

a stationary framework;

a foldable bed frame connected to and foldable into said framework, said foldable frame having an outer section pivotally attached to an intermediate section which is pivotally attached to an intermediate section overlying the body section in the folded position of the frame to form a seat deck;

said outer section having a plurality of individual seat support elements extending thereacross transversely to the axis of pivotal attachment of said outer section to said intermediate section, said individual elements being spaced apart in a direction parallel to said axis, and each of said individual elements being downwardly deflectable independently of the others when a person sits on said seat deck;

each of said individual elements comprising a sinuous spring wire, and said spring wires being arched and mounted so as to create a concavity adapted to receive a sofa seat cushion in the sofa form of said sofa bed;

wherein said outer section comprises a frame portion having an outer end cross member connected to an inner cross member, said members being spaced apart and connected together by a pair of side members, said individual elements being attached at their ends to said outer and inner cross members respectively, said inner cross member being connected to said intermediate section such that said individual elements extend the same length between said cross members in both the folded and unfolded positions of the frame;

and a mattress support link fabric, means to mount said fabric to said intermediate section, an anchoring member, means to anchor the ends of said link fabric to said anchoring member, and means to fix said anchoring member to said support elements a predetermined distance to the side of the pivotal attachment between said outer and intermediate sections towards the outer end of said outer section.

* * * * *